US006949037B2

(12) United States Patent
Enos et al.

(10) Patent No.: US 6,949,037 B2
(45) Date of Patent: Sep. 27, 2005

(54) QUICK-RELEASE FASTENER FOR RELEASABLY ATTACHING LACROSSE STICK HEAD TO SHAFT

(75) Inventors: Richard A. Enos, 111 Walnut St., Penn Yan, NY (US) 14527-1328; Robert Huling, Geneva, NY (US)

(73) Assignee: Richard A. Enos, Penn Yan, NY (US)

( * ) Notice: Subject to any disclaimer, the term of this patent is extended or adjusted under 35 U.S.C. 154(b) by 22 days.

(21) Appl. No.: 10/648,817

(22) Filed: Aug. 26, 2003

(65) Prior Publication Data

US 2004/0072638 A1 Apr. 15, 2004

Related U.S. Application Data

(63) Continuation-in-part of application No. 10/256,577, filed on Sep. 27, 2002, now abandoned.

(51) Int. Cl.[7] ..... A63B 59/02; A63B 65/12
(52) U.S. Cl. ..... 473/513; 403/6
(58) Field of Search ..... 473/513; 411/946; 403/7, 328, 109.3

(56) References Cited

U.S. PATENT DOCUMENTS 1,852,071 A * 4/1932 Becker ..... 4/255.11
2,031,044 A * 2/1936 Jensen et al. ..... 294/61
2,319,992 A * 5/1943 Hubbard ..... 294/19.1
2,606,050 A * 8/1952 Morris et al. ..... 403/328
2,719,688 A * 10/1955 Seifert ..... 248/188.5
2,980,456 A * 4/1961 McMullin ..... 403/328
3,214,187 A * 10/1965 Fuerst ..... 280/654
3,910,578 A 10/1975 Brine, Jr. ..... 273/96
4,037,841 A * 7/1977 Lewis, Jr. ..... 473/513
4,385,849 A * 5/1983 Crain ..... 403/109.3
4,940,243 A 7/1990 Tucker et al. ..... 273/326
5,007,652 A 4/1991 Tucker et al. ..... 273/326
5,082,290 A * 1/1992 Tucker et al. ..... 473/513
5,271,682 A 12/1993 Realdon ..... 401/37
5,566,947 A * 10/1996 Tucker et al. ..... 473/513
5,685,791 A * 11/1997 Feeney ..... 473/513
5,935,026 A * 8/1999 Dill et al. ..... 473/513
6,450,557 B1 9/2002 Martinez ..... 294/19.1
6,595,713 B1 * 7/2003 Wilson ..... 403/7

* cited by examiner

*Primary Examiner*—Gregory Vidovich
*Assistant Examiner*—M. Chambers
(74) *Attorney, Agent, or Firm*—Brown & Michaels, PC

(57) ABSTRACT

A quick-release fastener for releasably attaching the head to the shaft of a lacrosse stick includes a fastener body and a tension pin, affixed to and extending through the fastener body, the tension pin including a compression spring and one or more end caps, the end caps protruding from one end, or two opposite ends, of the fastener body, and the tension pin being arranged such that when the end caps of the tension pin are compressed against the spring, the end caps are recessed into the fastener body.

15 Claims, 8 Drawing Sheets

THE QUICK RELEASE

STYLE: "A"
DIM.IN: INCHES
SCALE: 2X

QUICK-RELEASE FASTENER FOR RELEASABLY ATTACHING LACROSSE STICK HEAD TO SHAFT

REFERENCE TO RELATED APPLICATIONS

This is a continuation-in-part patent application of application Ser. No. 10/256,577, filed Sep. 27, 2002, now abandoned entitled "QUICK-RELEASE FASTENER FOR RELEASABLY ATTACHING LACROSSE STICK HEAD TO SHAFT". The aforementioned application is hereby incorporated herein by reference in its entirety.

BACKGROUND OF THE INVENTION

1. Field of the Invention

The invention pertains to the field of sports equipment. More particularly, the invention pertains to a quick-release fastener for releasably attaching the head to the shaft of a lacrosse stick.

2. Description of Related Art

The game of lacrosse is considered to be the oldest team contact sport of North American origin. Historical evidence suggests that the game of lacrosse was played by various Indian tribes, such as the Iroquois and Hurons, as early in time as the 15th century. It generally is accepted that the original purpose of the sport of lacrosse was to physically and/or psychologically condition Indian warriors preparatory to actual combat or, in some instances, to itself function as a game forum for the settlement of tribal differences. While the equipment utilized in the sport of lacrosse has, of course, evolved substantially over the years, one all-important piece of equipment whose basic constructional characteristics have remained constant is the lacrosse stick or "crosse".

Since the inception of the sport, the lacrosse stick has comprised an elongate stick having a butt end and a forward end, and a head integral with or fixedly attached and coaxial to the forward end of said stick. Typically, the head comprises a frame including at least one side wall element extending forwardly of the forward end of the stick and in a laterally divergent manner from the center line thereof, and a nose element extending transversely across the forward end(s) of said side wall element(s), said nose element traversing the forwardly extended center line of said stick. The upper rim of said head frame defines an open mouth wherethrough the lacrosse ball is received into and shot, passed or checked from the lacrosse stick. In plan view, the head frame typically defines a generally isosceles triangular area extending coaxially and forwardly of the forward end of the stick. Generally, the rear portion of the head frame is arcuately formed, the radius of curvature of said rear portion being selected such that it defines an accommodating surface against which the lacrosse ball usually rests, while the ball is retained in the throat portion of the head frame. Suspended from the lower rim of the head frame is a netting defining a bottom closure of the frame.

With the decreasing availability of high-grade ash or hickory wood, decreasing availability of the woodworking skills necessary to form and fabricate lacrosse sticks having integral one-piece wooden stick/head frame constructions, and in further view of the labor intensive nature of the fabrication of such integral one-piece wooden stick/head frame constructions, it has become commonplace to fabricate lacrosse sticks using a straight stick or shaft element formed of straight grained wood or wood laminate or a tough, lightweight metallic or reinforced plastic tubular material, such as in the nature of a thin gauge metallic extrusion or a fiber reinforced composite plastic material, and to affix to the forward end of the shaft a separate head frame comprising a tough synthetic thermoplastic material, such as a high impact strength nylon material prepared and/or sold under the trademark, ZYTEL®, by DuPont de Nemours & Company, Inc., Wilmington, Del.

In such modem versions of a lacrosse stick, the head frame typically comprises a rearwardly oriented coaxial socket element to receive the forward end of the shaft therein. Typically, the head and shaft are fastened together at the junction thereof using a fastener, usually a screw, extending through a portion of the head and shaft at the junction, such as described in U.S. Pat. No. 3,910,578. Often, athletes also place tape around the junction of the head and shaft, for added safety to prevent the fastener from falling out.

Thus, the modem lacrosse stick, having a separate head and shaft, allows athletes to exchange the heads and shafts, such as in cases where the head or shaft becomes worn or damaged, or where a different head or shaft is desired for play or for various other reasons. Thus, often athletes exchange the head or shaft, even during a game. However, a screwdriver or other suitable implement typically is required to remove the screw, which also is relatively time-consuming, considering that often the exchange must be made during a brief time-out or between plays. Therefore, there is a long-standing need for a quick-release fastener for releasably attaching the head to the shaft of a lacrosse stick, allowing the head and shaft of a lacrosse stick to be quickly separated and exchanged, while still providing means for securely fastening the head and shaft during play.

SUMMARY OF THE INVENTION

Briefly stated, a quick-release fastener for releasably attaching the head to the shaft of a lacrosse stick includes a fastener body and a tension pin, affixed to and extending through the fastener body, the tension pin including a compression spring and end caps, the end caps protruding from opposite ends of the fastener body, and the tension pin being arranged such that when the end caps of the tension pin are compressed against the spring, the end caps are recessed into the fastener body.

DETAILED DESCRIPTION OF THE INVENTION

The present invention provides a quick-release fastener for releasably attaching the head to the shaft of a lacrosse stick.

EXAMPLE 1

Figure 1:
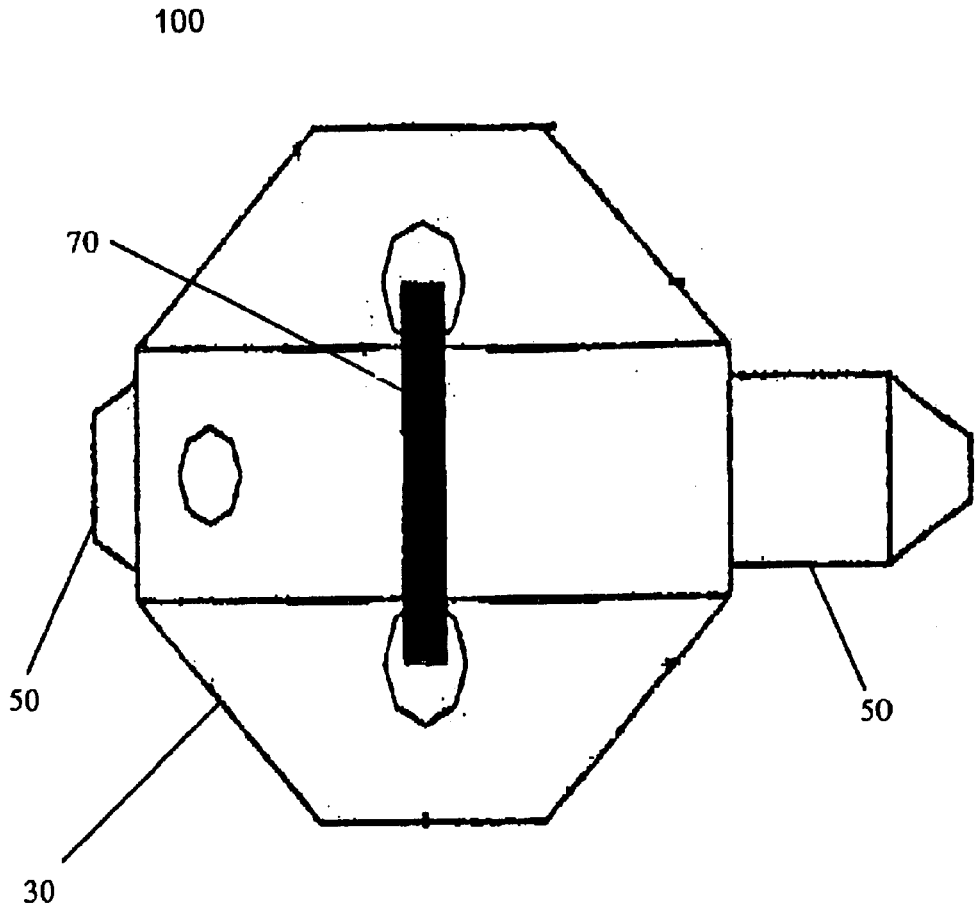
FIG. 1 shows a diagram of the top view of a fastener, according to the present invention.
Figure 2A:
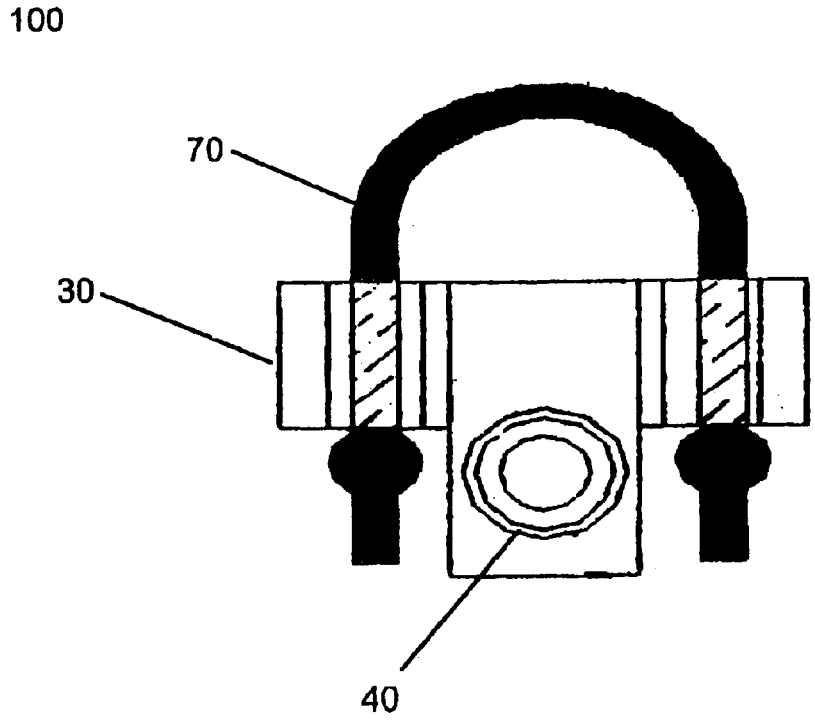
FIGS. 2A and 2B, respectively, show a diagram of the front and back views of a fastener, according to the present invention.
Figure 2B:
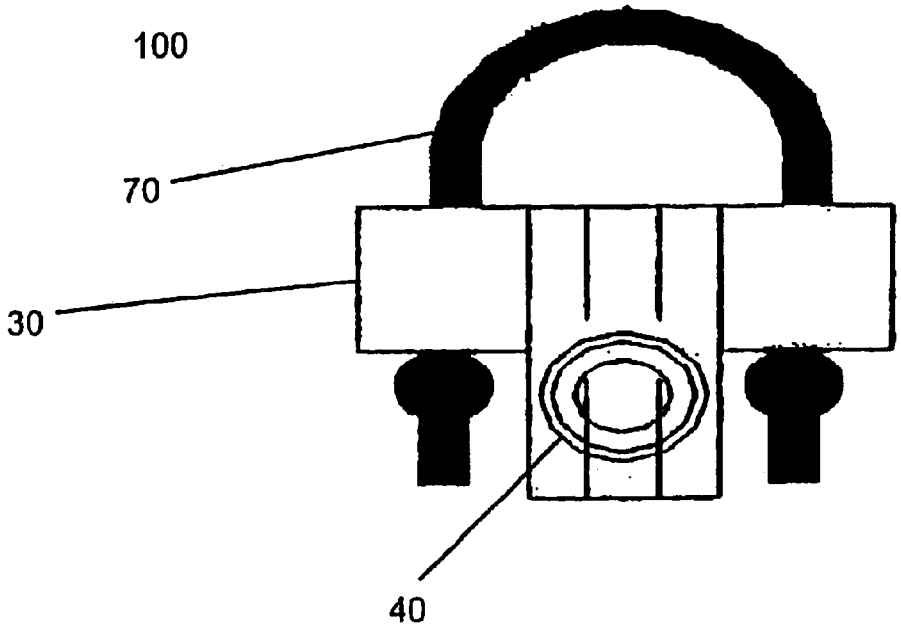
Figure 3:
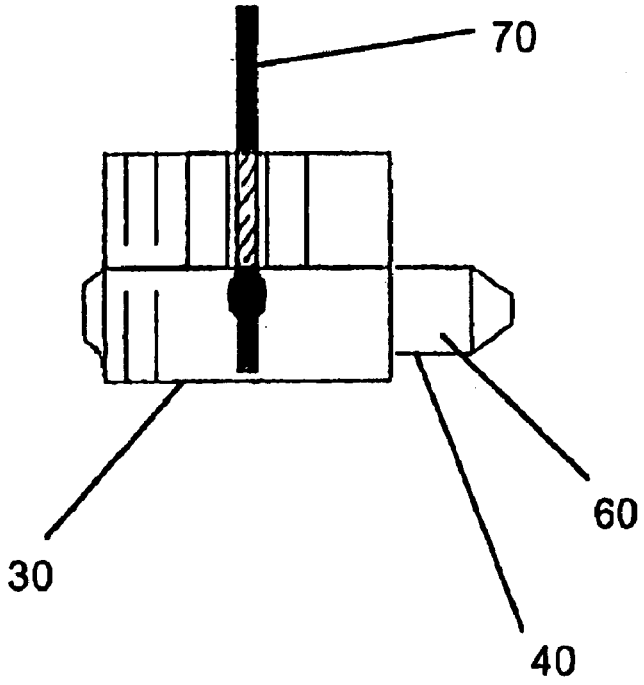
FIG. 3 shows a diagram of the side view of a fastener, according to the present invention.
Figure 4:
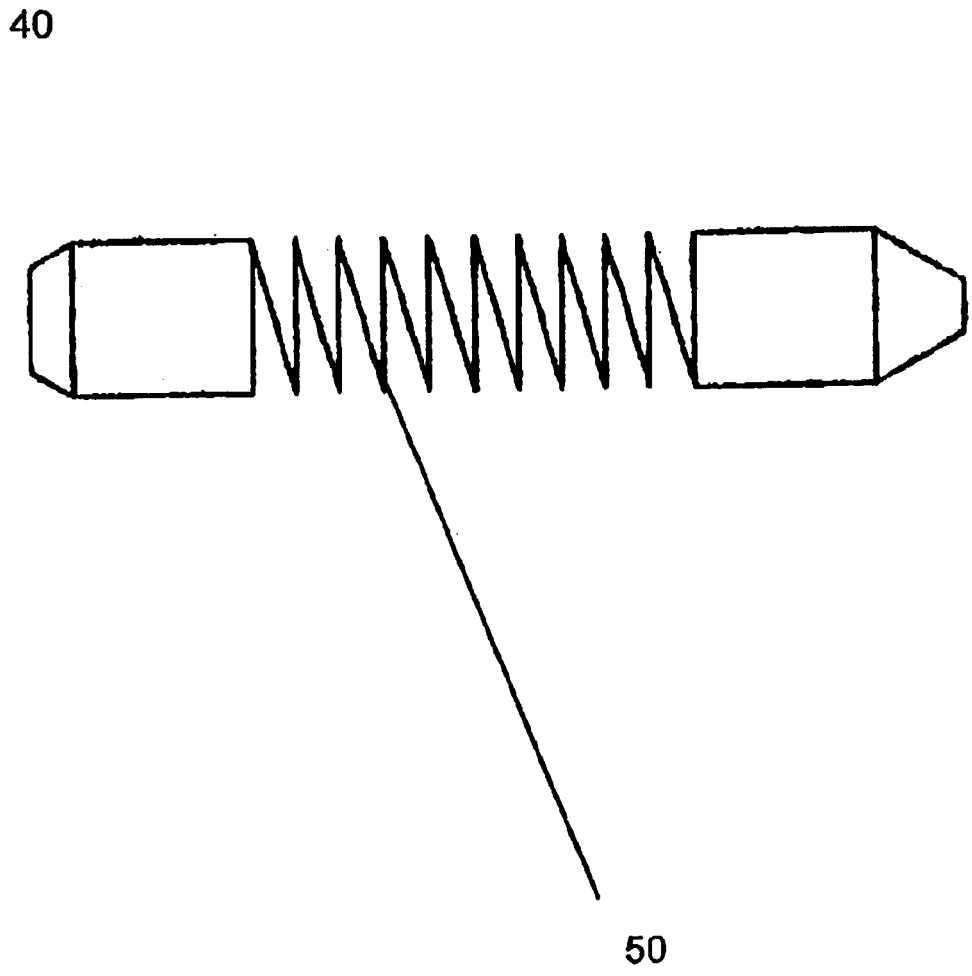
FIG. 4 shows an exploded view of the tension pin of a fastener, according to the present invention.
Figure 5:
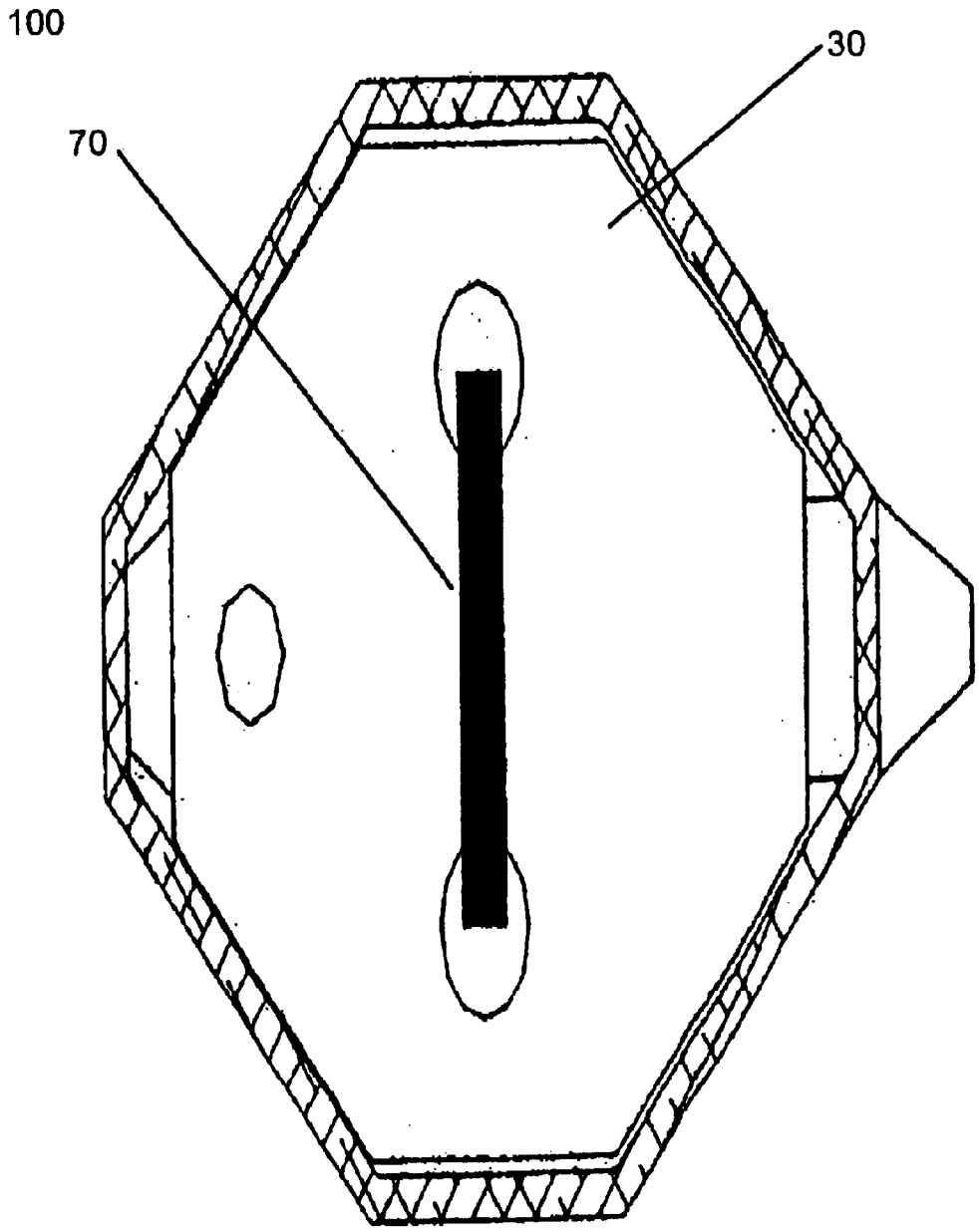
FIG. 5 shows a diagram of the top view of a fastener, according to the present invention, wherein the fastener is inserted into the end of the shaft.
Figure 6:
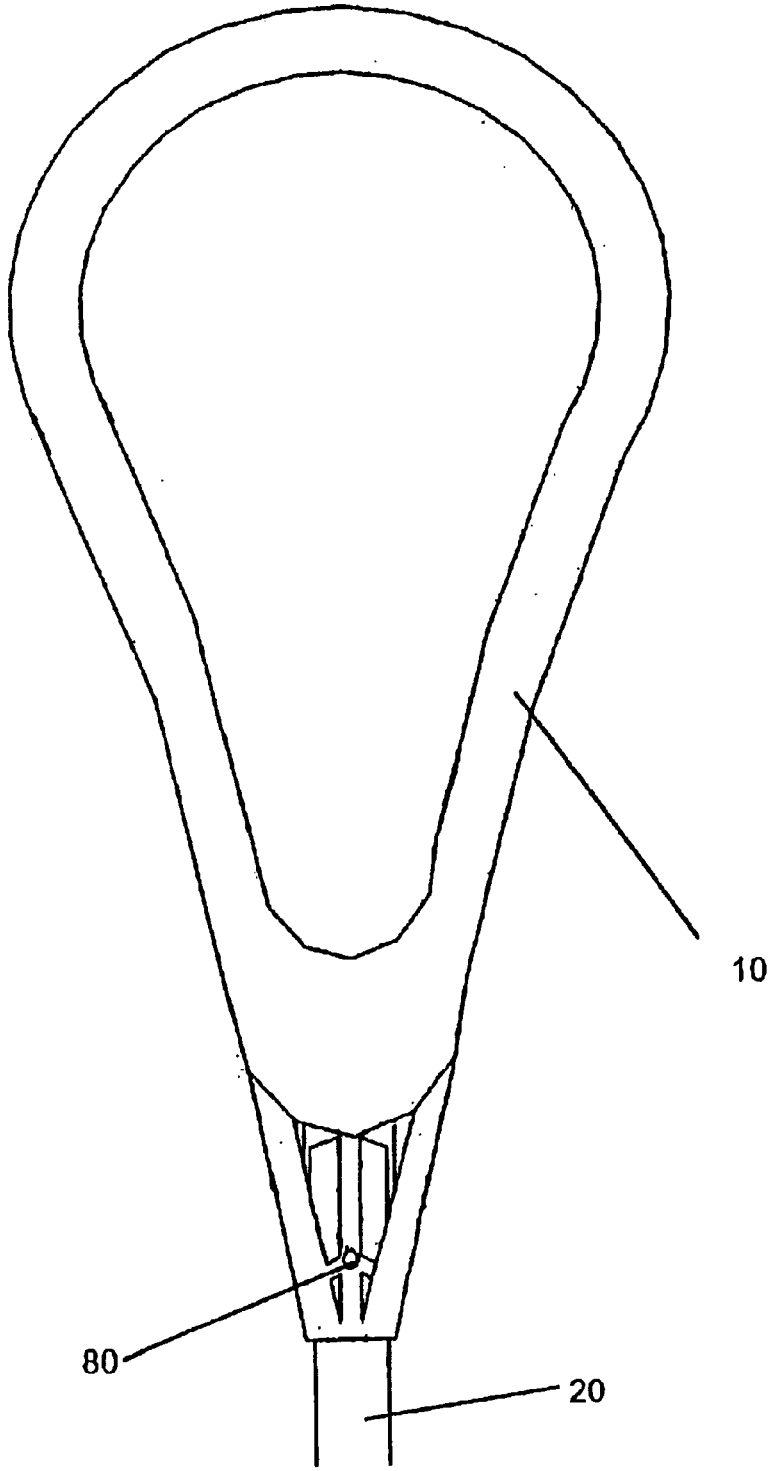
FIG. 6 shows a diagram of the head and shaft of a lacrosse stick, according to the present invention, showing the location of the apertures for engagement with the tension pin end caps.

Referring now to FIG. 1, a top view of an embodiment of a fastener 100 for releasably attaching the head 10 to the shaft 20 of a lacrosse stick is shown, comprising a fastener body 30 and a tension pin 40, affixed to and extending through the fastener body, the tension pin including a compression spring 50 and end caps 60, the end caps protruding from opposite ends of the fastener body, and the tension pin being arranged such that, when the end caps of the tension pin are compressed against the spring, the end caps are recessed into the fastener body.

In the preferred embodiment, the fastener body is milled from a high modulus nylon or plastic composition having high strength and stiffness, suitable for metal replacement applications, such as, for example, a nylon material prepared and/or sold under the trademark, CAPRON® (HMG13 HS BK-102), by Honeywell Plastics, Inc., Morristown, N.J. While the present example shows a fastener body having a substantially octagonal shape, other shapes are suitable, such as hexagonal, rectangular, square, oval, round, or other shapes that allow the fastener body to fit snugly within said shaft without twisting substantially. Preferably, the fastener body is shaped to correspond roughly with the inside dimensions of the lacrosse stick shaft.

Optionally affixed to the fastener is means 70 for grasping or pulling the fastener from the shaft. In the preferred embodiment, the grasping or pulling means comprises an extraction tether for grasping or pulling the fastener from within the shaft. In the present example, the extraction tether comprises a nylon cord of about five inches in length and about 1/16 inch in diameter, threaded through two approximately 1/8 holes in the fastener body, with knots on either end of the cord to hold it in place.

In the present example, the apertures 80 in the lacrosse stick head and shaft are approximately 7/32 inches in diameter, and the fastener body has a 3/32 inch bore to accommodate the tension pin, which in the present example is approximately 7/32 inches in diameter and about 1 5/16 inches in length overall. In the present example, the end caps of the tension pin extend from the fastener body approximately 1/16 inch in the front and 3/8 inches in the back. The tension pin is fixed within the fastener body, such that the pin cannot fall out of place or be lost. Further, in the present example, the compression spring is 5/32 inches in diameter and 5/8 inches in length, and the spring preferably is welded to plastic end caps of the tension pin. In the example, the force required to compress the spring (1/4 inch travel) is approximately 4.75 pounds. This is the preferred embodiment, however, the spring could be stronger or weaker, as long as it is strong enough to hold the tension pin in place securely, while the lacrosse stick is in use, and as long as it is not so strong as to make compression of the spring with the fingers so difficult as to make the fastener unweildly or very difficult to use.

Use of the quick-release fastener is simple. One merely compresses the end caps against the spring and then inserts the fastener into a lacrosse stick shaft. Upon releasing the compression on the end caps, the tension pin engages the apertures in the shaft and the end caps extend to fasten the fastener to the shaft. A lacrosse stick head is then selected and the end caps compressed again, to allow the rearwardly oriented coaxial socket element of the head to be fitted onto the forward end of the shaft. Once the head is in place and the apertures in the head are aligned with the end caps, the compression is again released and the tension pin engages both the shaft and the head. The exchange of the head and/or shaft then merely requires compression of the end pins, so that the head and shaft can be separated and exchanged as desired. Thus, the invention provides convenient means for quickly and reliably attaching the head to the shaft of a lacrosse stick, such that said head is securely affixed to said shaft for play, and quickly released from said shaft, when said end caps of said tension pin are compressed.

EXAMPLE 2

Figure 7A:
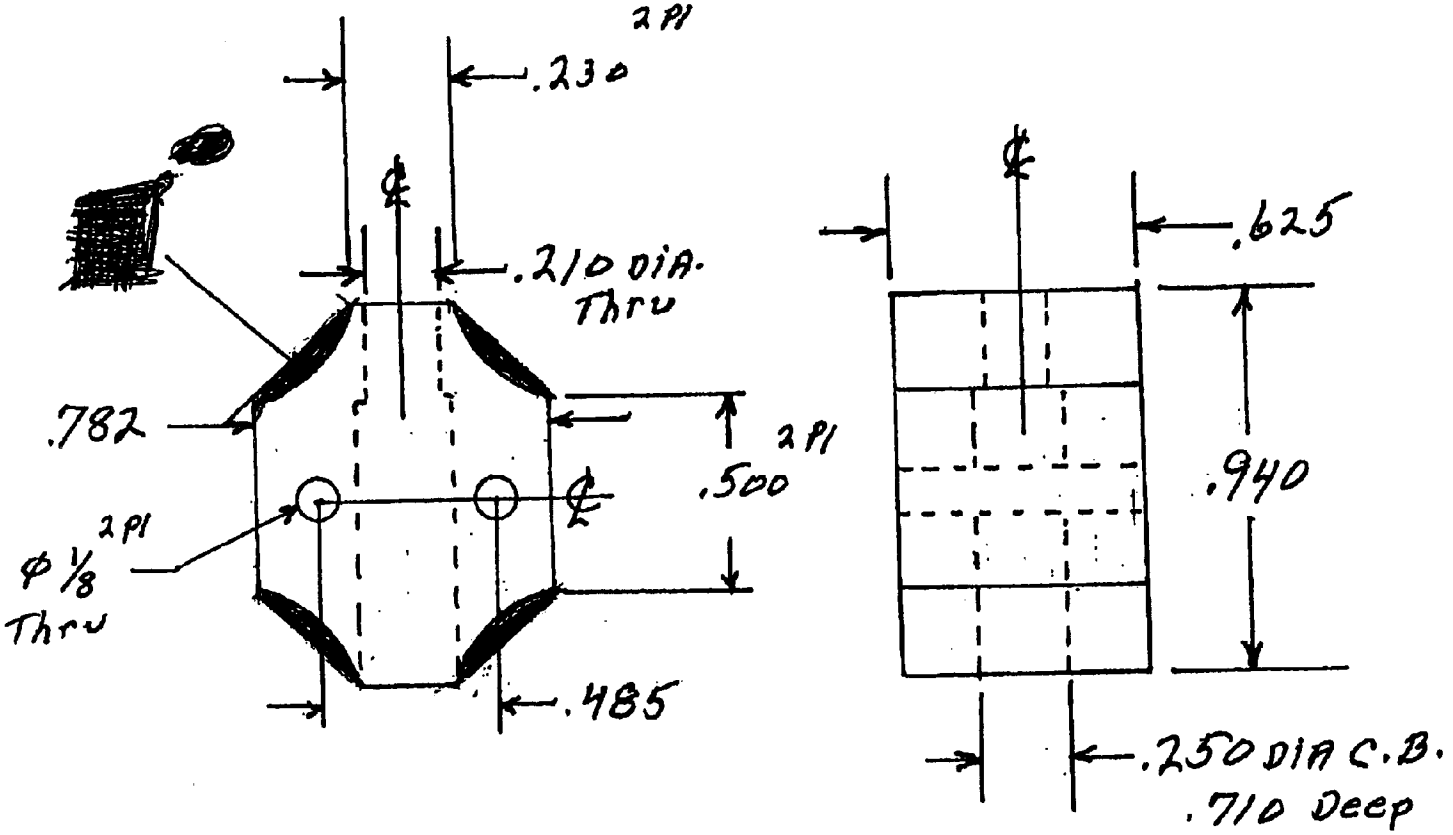
FIGS. 7A and 7B show an alternative embodiment having a single tension pin that extends from only one side of the fastener.
Figure 7B:
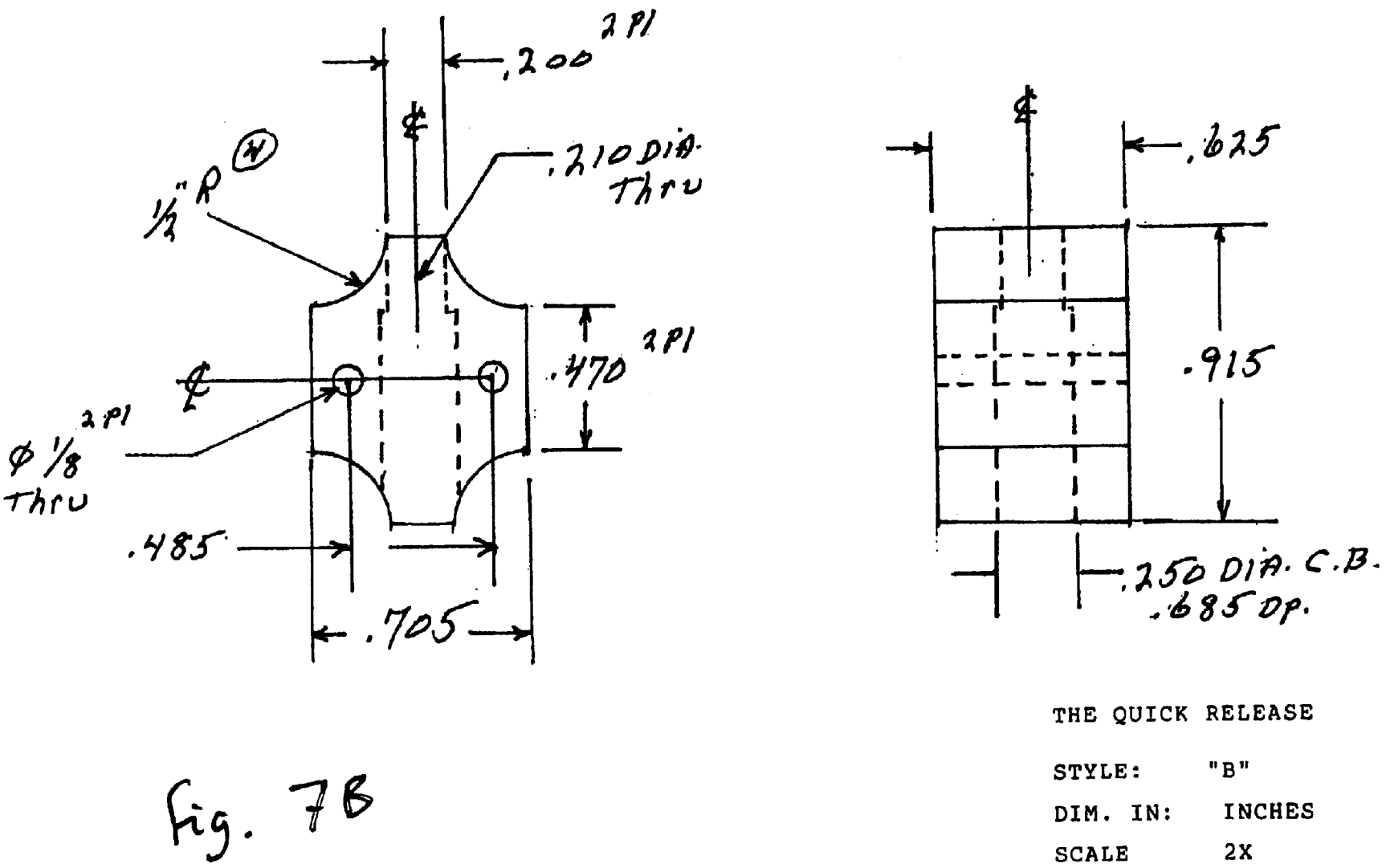

Referring now to FIGS. 7A and 7B, an alternative embodiment is shown. In the alternative embodiment, the fastener includes only a single tension pin, arranged such that it extends from only one side of the fastener body. Preferably the pin comprises brass, to prevent rusting or other corrosion. The spring preferably is the same as that of Example 1 and the material for the fastener body preferably is a high impact strength nylon material, such as that prepared and/or sold under the trademark, ZYTEL®, by DuPont de Nemours & Company, Inc., Wilmington, Del. In the alternative embodiment of Example 2, the manufacturing process is such that the spring and brass pin are press-fit into the fastener body, thereby anchoring one end of the spring inside the fastener body.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fastener for releasably attaching a lacrosse stick head to a lacrosse stick shaft, comprising:

a) a fastener body; and b) a tension pin, affixed to and extending through said fastener body, said tension pin including a compression spring and one or more end caps, said end caps protruding from one end, or two opposite ends, of said fastener body, and said tension pin being arranged such that when said end caps of said tension pin are compressed against said spring, said end caps are recessed into said fastener body, and wherein said fastener comprises a removable unitary assembly; and c) means affixed to said fastener for grasping or pulling said fastener from said shaft;

wherein said means for grasping or pulling comprises a tether, string or thread.

2. The fastener of claim 1, wherein said fastener body comprises a high modulus nylon or plastic composition having high strength and stiffness, suitable for metal replacement applications.

3. The fastener of claim 1, wherein a cross-section of said fastener body is substantially octagonal, hexagonal, rectangular, square, oval, round, or otherwise shaped to fit snugly within said shaft without twisting substantially.

4. The fastener of claim 1, wherein said compression spring comprises a metal or metal alloy composition.

5. The fastener of claim 4, wherein a force required to compress said spring is between four and five pounds.

6. A fastener for releasably attaching a lacrosse stick head to a lacrosse stick shaft, comprising:

a) a substantially solid fastener body, comprising a plug for insertion into a forward end of said shaft;

b) a tension pin for engaging said shaft and said head, affixed to and extending through said fastener body, said tension pin including a compression spring and one or more end caps, said end caps protruding from one end, or two opposite ends, of said fastener body, and said tension pin being arranged such that when said end caps of said tension pin are un-compressed, said end caps extend substantially through one or more apertures in said shaft and said head, and wherein said fastener comprises a removable unitary assembly; and c) means affixed to said fastener for grasping or pulling said fastener from said shaft;

wherein said means for grasping or pulling comprises a tether, string or thread.

7. The fastener of claim 6, wherein said fastener body comprises a high modulus nylon or plastic composition having high strength and stiffness, suitable for metal replacement applications.

8. The fastener of claim 6, wherein a cross-section of said fastener body is substantially octagonal, hexagonal, rectangular, square, oval, round, or otherwise shaped to fit snugly within said shaft without twisting substantially.

9. The fastener of claim 6, wherein said compression spring comprises a metal or metal alloy composition.

10. The fastener of claim 9, wherein a force required to compress said spring is between four and five pounds.

11. A lacrosse stick, comprising:

a) an elongate shaft having a butt end and a forward end;

b) a head comprising a frame including a rearwardly oriented coaxial socket element to receive said forward end of said shaft, wherein said coaxial socket of said head is engaged with said forward end of said shaft; and c) a fastener releasably attaching said head to said shaft, wherein said fastener comprises a removable unitary assembly, and wherein said fastener comprises;

i) a fastener body coaxially engaged with said forward end of said shaft; and ii) a tension pin, affixed to and extending through said fastener body, said tension pin including a compression spring and one or more end caps, said end caps protruding from one end, or two opposite ends, of said fastener body, and said tension pin being arranged such that when said end caps of said tension pin are un-compressed, said end caps extend substantially through one or more apertures in said shaft and said head, such that said head is securely affixed to said shaft, and quickly released from said shaft, when said end caps of said tension pin are compressed; and iii) means affixed to said fastener for grasping or pulling said fastener from said shaft;

wherein said means for grasping or pulling comprises a tether, string or thread.

12. The lacrosse stick of claim 11, wherein said fastener body comprises a high modulus nylon or plastic composition having high strength and stiffness, suitable for metal replacement applications.

13. The lacrosse stick of claim 11, wherein a cross-section of said fastener body is substantially octagonal, hexagonal, rectangular, square, oval, round, or otherwise shaped to fit snugly within said shaft without twisting substantially.

14. The lacrosse stick of claim 11, wherein said compression spring comprises a metal or metal alloy composition.

15. The lacrosse stick of claim 14, wherein a force required to compress said spring is between four and five pounds.

* * * * *